United States Patent [19]

Sando et al.

[11] 4,419,869

[45] Dec. 13, 1983

[54] APPARATUS FOR TREATING A CLOTH WITH THE USE OF LOW-TEMPERATURE PLASMA

[75] Inventors: Yoshikazu Sando, Wakayama; Tokuju Goto, Nara; Itsuo Tanaka, Osaka; Hiroshi Ishidoshiro; Matsuo Minakata, both of Wakayama, all of Japan

[73] Assignee: Sando Iron Works Co., Ltd., Wakayama, Japan

[21] Appl. No.: 458,986

[22] Filed: Jan. 18, 1983

[30] Foreign Application Priority Data

Jan. 26, 1982 [JP] Japan ..... 57-10441

[51] Int. Cl.[3] ..... D06B 3/10

[52] U.S. Cl. ..... 68/5 D; 204/165; 422/186.04

[58] Field of Search ..... 422/186.04, 186.05; 204/165; 68/5 R, 5 D, 5 E, 13 R

[56] References Cited

U.S. PATENT DOCUMENTS

| | | | |
|---|---|---|---|
| 3,069,283 | 12/1962 | Coleman | 422/186.04 X |
| 3,740,325 | 6/1973 | Manion et al. | 204/169 |
| 3,817,701 | 6/1974 | Thorsen | 204/168 X |

*Primary Examiner*—F. Edmundson

*Attorney, Agent, or Firm*—Toren, McGeady and Stanger

[57] ABSTRACT

An apparatus for treating a cloth with the use of low-temperature plasma comprising a pair of closed cloth taking-up cases provided respectively with a slit-type cloth taking-in and out opening and a cloth taking-up shaft, a cloth passage tube connecting to the two cloth taking-up cases for transporting the cloth therethrough, one or more pairs of electrode plates provided at the outer circumference of the cloth passage tube, a gas supply pipe connected to the cloth passage tube, and a gas evacuating pipe provided in the vicinity of the cloth taking-in and out opening.

2 Claims, 2 Drawing Figures

APPARATUS FOR TREATING A CLOTH WITH THE USE OF LOW-TEMPERATURE PLASMA

BACKGROUND OF THE INVENTION

The present invention relates to an apparatus for treating a cloth such as knitted, woven and non-woven ones with the use of low-temperature plasma.

In treating a cloth industrially, there are a process of scouring prior to dyeing, in which water repellent foreign matters adhering to the cloth is removed or made into hydrophilic for permeating a dye solution easily in the cloth an a process of finishing after dyeing, in which such characteristic properties as softness, water repellency, resistance against electrostatic and resistance against staining are applied to the cloth, and these processes have conventionally been done in an aqueous system.

For instance, in scouring a cloth containing cotton, it is necessary to treat the cloth with an alkaline scouring solution containing such an agent as caustic soda or soda ash for solubilize water repellent foreign matters, to repeat washing for removing such matters as the agent and the solubilized foreign matters adhering to the cloth, and finally to dry the washed cloth. In the finishing process, it is necessary to treat the cloth with a finishing agent dissolved or dispersed in water, to filter and finally to dry the cloth with the use of a drier. According to the kind of treatment, it is necessary further to fix the finishing agent to the cloth by a high temperature heat treatment.

However, it is the present status in such a treating process that the treating agent is costly, a large amount of heat is necessary for the reaction between the agent and the cloth, and a large size washing machine and a large amount of water are needed for removing foreign matters and treating agent from the cloth, thus large quantities of water resource and heat energy are consumed uneconomically.

Moreover, since the waste water from the washing machine contains unavoidably the treating agent, causing the problem of public pollution, its treatment needs large installation cost and personnel expenses. Thus, the conventional pretreatment and finishing of a cloth are not economical.

Under such circumstances, it has recently been proposed to subject a textile product such as a cloth to a low-temperature plasma treatment for desizing and sourcing, and further for finishing to make the textile product soft, water repellent, anti-electrostatic, anti-staining and so on.

However, low-temperature plasma treating apparatuses hitherto proposed are to transport a long textile product taken up on a shaft or a roll to another shaft or roll while the cloth is treated with low-temperature plasma in a batch. A taken-up long textile product is placed constantly in the low-temperature plasma atmosphere in a batch during operation. While both end parts of the textile product are exposed always to the low-temperature plasma atmosphere, the core parts of the textile product are in contact with the low-temperature plasma for the first time in transferring the textile product to the other shaft or roll. Therefore, there occurs such a trouble that the treatment cannot be done uniformly. That large amounts of gas and electric energy are consumed for maintaining the total interior of the batch to a low-temperature plasma atmosphere is another difficulty.

SUMMARY OF THE INVENTION

The object of the present invention is, accordingly, to offer an apparatus for treating a long cloth efficiently and uniformly in batches by utilizing low-temperature plasma.

The principle of the invention is to transfer a long cloth taken up on a shaft to another shaft while transporting the cloth through a low-temperature plasma atmosphere in a cloth passage tube with a limited spaced. In the present invention, the treatment of a cloth such as scouring and finishing can be done uniformly and efficiently by using low-temperature plasma with the consumption of limited amounts of treating agent, water resource and heat energy economically.

DETAILED DESCRIPTION OF THE PREFERRED EMBODIMENTS

Preferred embodiments of the present invention will be described in detail in the following with reference to the attached drawings.

Figure 1:
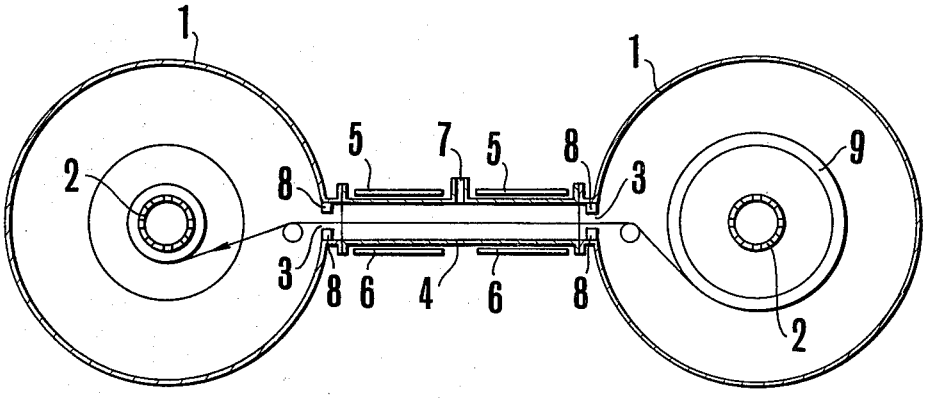
FIG. 1 is a sectional diagram showing the whole aspect of an example of the present inventive apparatus for treating a cloth with the use of low-temperature plasma.
Figure 2:
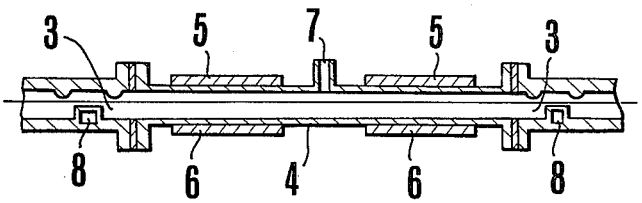
FIG. 2 is an enlarged sectional diagram of the essential part of the apparatus shown in FIG. 1.

In FIGS. 1, 2 are a pair of cloth winding-up case, and the cloth winding-up cases 1 are respectively of a closed structure except a cloth taking-in and out opening 3 with a slit-type structure. 4 is a narrow cloth passage tube provided between the cloth winding-up case pairs, and the cloth passage tube 4 is composed of a material permeable to high frequency electric wave such as quartz and heat resistant glass. Both side openings of the cloth passage tube 4 are connected airtightly to the cloth taking-in and out opening 3, and the outer circumference of the cloth passage tube 4 is fitted with one or more electrode plate pairs 5 and 6, the one group being connected to an oscillator for producing high frequency electric wave (not shown in the drawing) and the other group being earthed. The cloth passage tube 4 is provided with a gas supply pipe 7.

The construction of the essential parts of the apparatus can more distinctly be understood from FIG. 2. As seen from FIG. 2, the cloth taking-in and out openings 3 are designed so that their openings are possibly small in size so long as the cloth can be transported therethrough continuously, and the cloth taking-in and out openings 3 are provided respectively with a gas evacuating pipe 8, and the gas evacuating pipe 8 is connected to a vacuum pump (not shown in the drawing).

The construction of the present inventive apparatus in this example is as above-described. Now, its functions will be explained in the following.

A long cloth to be treated 9 is taken up to one of the cloth winding-up shaft 2, and the front end of the cloth is attached to another winding-up shaft by connecting both winding-up cases 1 to the cloth passage tube 4 at the cloth taking-in and out openings 3. A pump (not shown in the drawing) is driven for evacuating the interior of the cloth winding-up cases 1 and the cloth passage tube 4 through the gas evacuating pipe 8 to a vacuum degree of not more than 1 Torr or desirably from 0.6 to 0.7 Torr. Then, a gas is supplied from the gas supply pipe 7 to the cloth passage tube 4 to control the vacuum degree of the interior of the cloth passage tube 4 to 0.1 to 10 Torr or desirably, 0.5 to 5 Torr, and high frequency electric wave with a frequency of, for instance, 13.35 MHz is supplied from the high frequency electric source to the electrode plates 5 and 6 for making the interior of the cloth passage tube 4 to an atmosphere of low-temperature plasma. The cloth 9 is transported through the cloth passage tube 4 by driving the cloth winding-up shaft 2, and thus the cloth 9 is treated with low-temperature plasma.

As above-described, it is sufficient in this example that a cloth passage tube with a small capacity is maintained with low-temperature plasma. Therefore, the density of the low-temperature plasma can easily be elevated, and the treatment of a cloth with low-temperature plasma is done efficiently. The amounts of gas and electric power for producing low-temperature plasma can be spared economically. Furthermore, since electrode plates are provided outside of the cloth passage tube, the electrodes do not etched by the plasma, elevating the durability of the electrodes. Since the cloth passage tube 4 is made of quartz tube or heat resistant glass tube, the interior of the cloth passage tube can beneficially be observed.

Still further, an evacuating pipe 8 are provided in the vicinity of the cloth taking-in and out openings 3 in this example, so that the low-temperature plasma in the cloth passage tube 4 scarcely flows in the cloth winding-up case, and therefore, the end part of the wound-up cloth in the cloth winding-up case 1 is not radiated by low-temperature plasma, and the low-temperature plasma treatment of a long cloth can be done uniformly all over the cloth.

The cloth winding-up shaft 2 in the above-mentioned example may be made of a pipe permeable to gas for connecting the pipe to a vacuum pump. Then, with the joint effect of the evacuation through the evacuating pipe 8, the interior of the cloth winding-up case 1 can promptly be evacuated. Further, the wound-up cloth in the winding-up case 1 may previously be evacuated by a separate vacuum pump for removing water and other foreign matters adhering to the cloth effectively.

What we claim:

1. An apparatus for treating a cloth with use of low-temperature plasma, comprising a pair of closed cloth taking-up cases provided respectively with a slit-type cloth taking-in and out opening and a cloth taking-up shaft, a cloth passage tube composed of a material permeable to high frequency electric wave, connecting between the two cloth taking-up cases for transporting the cloth therethrough, at least one pair of electrode plates provided at the outer circumference of the cloth passage tube for receiving high frequency electric wave produced by an oscillator, a gas supply pipe connected to the cloth passage tube, and a gas evacuating pipe provided in the vicinity of the cloth taking-in and out opening.

2. An apparatus for treating a cloth with the use of low-temperature plasma according to claim 1, in which said cloth winding-up shaft is composed of a pipe permeable to gas for evacuating the gas therethrough.

* * * * *